United States Patent [19]

Hojyo

[11] 4,182,669

[45] Jan. 8, 1980

[54] AUTOMATIC ELECTROPLATING APPARATUS

[76] Inventor: Tetsuya Hojyo, 110 Karasugatsuji-cho, Tennoji-ku, Osaka, Japan

[21] Appl. No.: 963,180

[22] Filed: Nov. 24, 1978

[30] Foreign Application Priority Data

Nov. 28, 1977 [JP] Japan ..... 52-143041

[51] Int. Cl.[2] ..... C25D 17/00; C25D 17/16

[52] U.S. Cl. ..... 204/213; 204/199; 204/201; 204/232; 204/237; 204/239

[58] Field of Search ..... 204/199, 201, 213, 232, 204/237, 239

[56] References Cited

U.S. PATENT DOCUMENTS

| | | | |
|---|---|---|---|
| 3,270,855 | 9/1966 | Harper et al. | 204/213 X |
| 3,431,192 | 3/1969 | Kumpf | 204/213 |
| 3,809,641 | 5/1974 | Miyata et al. | 204/213 |
| 4,098,665 | 7/1978 | Frechin | 204/213 |

*Primary Examiner*—Arthur C. Prescott

*Attorney, Agent, or Firm*—Birch, Stewart, Kolasch & Birch

[57] ABSTRACT

An automatic electroplating apparatus which comprises a power-driven larger rotary drum containing plating solution therein, a plurality of power-driven smaller rotary drums disposed within the larger drum and immersed in the plating solution, and a plurality of through holes formed in each of the smaller drums for permitting the plating solution to interflow between insides of the larger and the smaller drums, each of the smaller drums being arranged so as to rotate on its own axis and synchronously to revolve orbitally around a vertical axis of the larger drum.

35 Claims, 4 Drawing Figures

AUTOMATIC ELECTROPLATING APPARATUS

BACKGROUND AND SUMMARY OF THE INVENTION

This invention relates to improvements in an electroplating apparatus for particular use in automatically electroplating a number of relatively small sized workpieces.

As well known in the art of automatically electroplating such small workpieces, for example, as small screws, washers, watch parts, etc., it is essential to hold the small workpieces in good contact relation with the cathode surface during operation. In order to attain the aforesaid good contact, a method of utilizing centrifugal force was proposed with success to a certain degree, as disclosed in U.S. Pat. No. 3,359,195 (the same invention also disclosed in Japanese Pat. No. 504509), wherein a plating drum was arranged so as to rotate about its own axis to develop the centrifugal force. According to the method, however, such a disadvantage is observed that, in order to attain uniform electrodeposition on the overall surface of each workpiece and to prevent undesirable blind spot (non-plated small surface area) from occasionally occurring with some of the treated workpieces, it is necessary to reduce the rotational speed of the plating drum three or four times repeatedly per each performance, for the purpose of changing the contacting positions of the workpieces with the cathode surface, causing poor efficiency.

Thus, in order to eliminate the above-mentioned disadvantage, an improved method has been proposed as disclosed in U.S. Pat. No. 3,425,926 (the same invention also disclosed in U.K. Pat. No. 1,062,360, German Pat. No. 1,496,819 and Japanese Pat. No. 555787), wherein a plurality of plating drums or tanks are rotatably and eccentrically mounted on a rotatable table so that each drum or tank is rotatable about its own axis and an extraneous axis, whereby the desired uniform and blind-spotless electrodeposition can be obtained. However, the aforesaid improved method has another problem that it is structurally very difficult to design an efficient and economical electroplating apparatus equipped with a plurality of rotary drums or tanks capable of containing a sufficient quantity of plating solution. A simply large dimension of each of the drums will never solve the problem, because it causes not only poor efficiency in electrodeposition but also a considerable energy loss due to invited large electric resistance between electrodes. The large dimension of each drum also causes an inevitably enlarged size of the whole apparatus, which invites high costs in manufacture, maintenance and operation.

In the electroplating of small workpieces, large dimension of the plating drums is not advantageous as described above. On the other hand, in case the plating solution contained in the drum is so small in quantity, temperature thereof tends to easily rise up to an undesirable degree due to the heat from operative electric current between the electrodes as well as the heat from friction of the rotating parts of the apparatus, causing remarkable decrease in electroplating efficiency, as is well known in the art. Thus, according to the aforementioned prior art apparatus as disclosed in U.S. Pat. No. 3,425,926, it is necessary to discontinue the operation every two hours or so, to exchange the heated solution afresh for the purpose of preventing a rise of the solution temperature, which is apparently quite troublesome and inefficient. As for prevention of a rise of the solution temperature, one may easily think of a method by provision of a suitable cooling means, but it was practically very difficult to attach the cooling device to a rotary drum.

It is, therefore, the principal object of the present invention to eliminate the above-mentioned disadvantages in the prior art.

Another object of the invention is to provide an improved electroplating apparatus capable of minimizing an undesirable rise of solution temperature in order to maintain a good plating efficiency, thereby avoiding frequent interruptions in operation for the solution exchange.

A further object of the invention is to provide an improved type of electroplating apparatus which facilitates uniform electrodeposition on the entire surface of each of the small workpieces by means of one or more smaller rotary drums arranged within a larger drum so as to positively hold the workpieces in good contact relation with the cathode surface by the centrifugal forces developed when the smaller drums are orbitally revolved, as well as to agitate the workpieces for dislocation without losing the good contact with the cathode surface as each of the smaller drums is rotated on its own axis.

The above and other objects, features and advantages of the invention will become more apparent from the following description of the preferred embodiments thereof taken in conjunction with the accompanying drawings. It is to be expressly understood, however, that the drawings are for purpose of illustration only and are not intended as definition of the limits of the present invention.

BRIEF DESCRIPTION OF THE DRAWINGS

The present invention will become fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
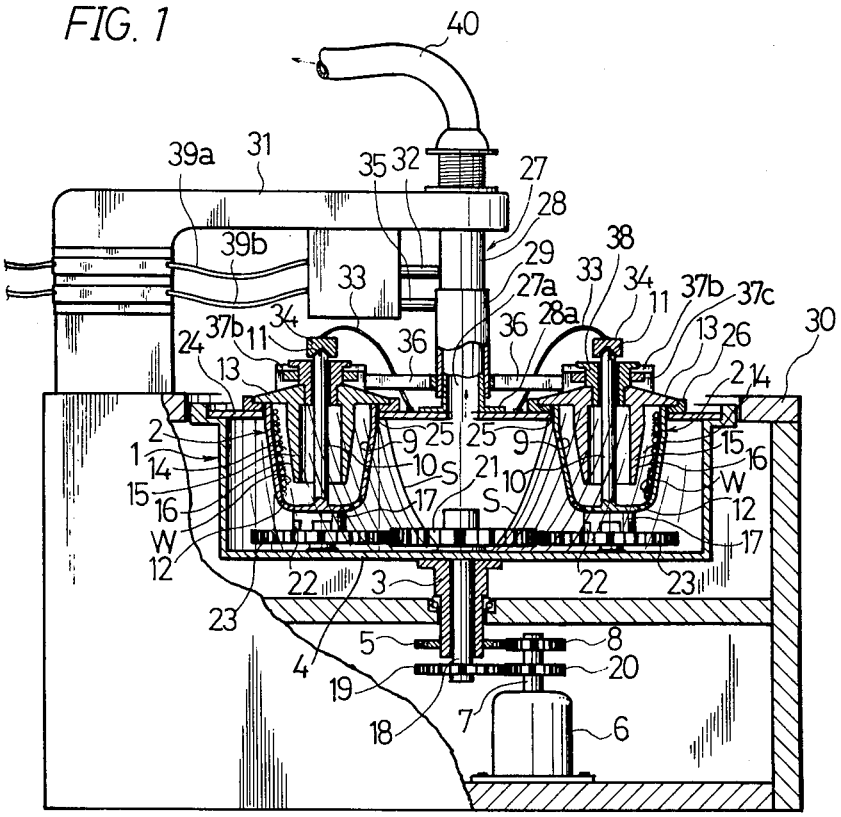
FIG. 1 is a front elevation, with parts broken away, illustrating the electroplating apparatus embodying the present invention.

Referring now to the drawings, in particular to FIGS. 1 thru 4, the electroplating apparatus according to the present invention comprises a larger rotary drum 1 of cylindrical configuration with a bottom wall, and a pair of smaller rotary drums 2 serving as barrels disposed within said larger drum. Apparently, the number of the smaller drums may be one or more. The larger drum is constructed so as to serve as a rotary reservoir for containing a sufficient quantity of plating solution therein. Each of the smaller drums 2 is arranged so as not only to orbitally revolve around the vertical axis of the larger drum 1 as the drum 1 rotates, but also to rotate on its own axis. The larger drum is adapted to rotate on a hollow vertical shaft 3, of which top end may preferably be formed into an annular flange so that it is easily secured to the external center area of the bottom wall of the drum 1. On the lower end of said shaft 3 is mounted a driven gear wheel 5, which is meshingly engaged with a drive gear wheel 8 mounted on a power output shaft 7 of a known drive source 6, for example a motor, so that the power therefrom can be transmitted to the shaft 3 for rotation.

Each of the smaller drums 2 is substantially cylindrical shape with open top and blind bottom, preferably being slightly reduced toward bottom. Each drum 2 is formed with a slightly inclined internal circumference 9 which serves as a cathode surface, and a bottom wall having a plurality of through holes 12 formed therein for permitting interflow of the plating solution between insides of both drums 1, 2. Within each smaller drum there is an upright pole 10 having a top end 11 projecting out of a stationary holed lid 13 to be hereinafter described.

Figure 4:
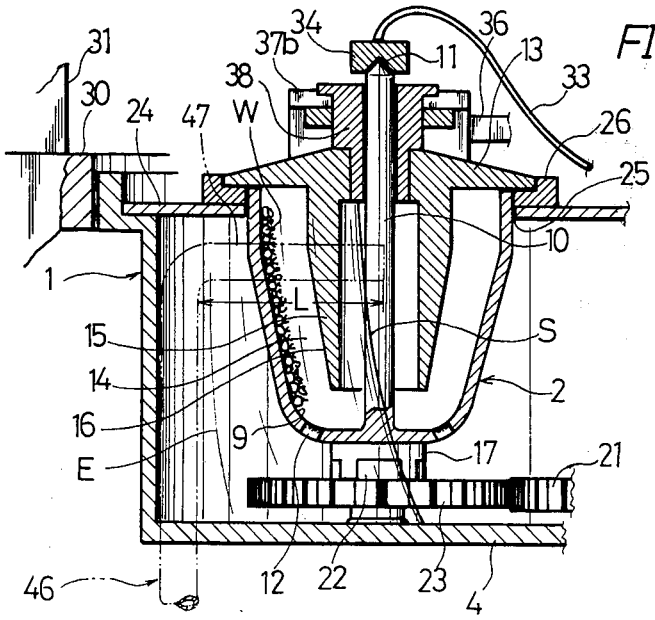
FIG. 4 is a greatly enlarged fragmentary cross section showing arrangement of an overflow pipe in relation to a smaller drum.

The pole 10 may be formed integral with the bottom wall of the drum 1 or otherwise welded thereto, in such a manner that it extends upright from the center of said bottom wall. The open top of each smaller drum is covered with the removable lid 13 in insulated relation therefrom. A hollow cylindrical element 15 with open bottom extends downward from the underside of the lid 13, so that an annular space 14 can be formed between said internal circumference 9 and the outer periphery 16 of said element 15, wherein said periphery 16 serves as an anode surface. The external diameter of the cylindrical element 15 may preferably be gradually reduced toward the bottom in accordance with the inclination of the cathode surface 9, so that the distance between both electrodes 9, 16 can be substantially constant as illustrated in FIG. 4. The lid 13 has a center hole formed therein for permitting insertion of said pole 10 therethrough. The lid 13 may preferably be provided at top with a hollow socket member 38. The internal surface of the member 38 should be insulated from said pole 10 inserted therethrough.

To the external surface of the bottom wall of each smaller drum 2 is rigidly secured a driven member 17 which cooperates for power transmission with a drive member 22 rigidly secured to each of a pair of driven gear wheels 23 which are meshed with a drive gear wheel 21. More particularly, the driven member 17 is disengageably coupled with the drive member 22 in a known manner, for instance by a slidable claw coupling. Either both or one or the other of the members 17, 22 may preferably be made of non-conductive material.

A drive shaft 18 for the smaller drums 2 passes through said hollow shaft 5 and further extends upward through the bottom wall 4 to terminate in the inside of the larger drum 1. A main gear wheel 21 is coaxially mounted on the upper extension of the shaft 18 extended into the drum 1. The lower end portion of the shaft 18 projects out of the lower extremity of the hollow shaft 5. On said lower end portion is mounted a driven gear wheel 19, which is meshed with a drive gear wheel 20 mounted on the output shaft 7 of the drive unit 6. Thus, the power can be transmitted not only to the pair of smaller drums for rotation via the gear wheels 20, 19, the shaft 18, the further gear wheels 21, 23 and the members 22, 17, but also to the larger drum via the gear wheels 8, 5 and the shaft 3 for simultaneous rotation with said smaller drums 1. In this embodiment herein described, the drums 1, 2 are so arranged as to be driven by a common drive unit 6, however, it is apparent that the smaller drums may be arranged so as to be independently driven by an extra drive unit (not shown).

The larger drum is covered at the top with a cover plate 24 having a pair of circular openings 25 formed therein, so that the smaller drums can be respectively inserted from above into the openings 25 so as to be rotatable therein. Each smaller drum can also be removed out of the larger drum through the opening 25. Each of said openings may preferably be hedged with a short annular support 26 of non-conductive character which supports the marginal edge of each lid 13.

An upright hollow cylindrical member 27 having an internal passageway **27*a* extends upward from the holed center area of said cover plate 24, so that the inside of the member 27 is intercommunicated with that of the larger drum 1. The cylindrical member 27 is rotatably supported at the top by a horizontal support arm 31 disposed above the top side of a frame housing 30. The cylindrical member 27 is constructed so as to provide a cathodic conductor 28 as well as an anodic conductor 29, both of them being, as a matter of course, conventionally insulated from each other. The upper part of the conductor 28 provides a contact surface with which a cathodic carbon 32 is in contact. The lower extremity of the conductor 28 may preferably be formed into an annular flange 28*a* which is rigidly secured onto the cover plate 24. Said flange is electrically connected through conductor wires 33 to each terminal cap 34 which is stationary in operation and detachably mounted in a known relatively rotatable contact relation to the top end 11 of the rotatable pole 10. As a result, the cathodic carbon 32 is electrically connected via conductive elements 28, 28*a*, 33, 34, 11 and 10 to the cathode surface 9** of each of the smaller drums, respectively.

The anodic conductor 29 has a contact surface with which an anodic carbon 35 is in contact, so that the carbon 35 is electrically connected via conductor strips 36 to the alternative of a pair of fixing elements **37*a*, 37*b* which are oppositely disposed in spaced apart relation so as to flank said annular support 26. The pair of fixing elements 37*a*, 37*b* cooperate to hold a set plate 37*c* therebetween which may be mounted to said socket member 38 and easily disengageable from the elements 37*a*, 37*b* when it is dislocated. Since said elements 37*a*, 37*b* are insulated from the cover plate 24, the anodic carbon 35 is electrically connected with the anode surface 16 via the conductive elements 29, 36, 37*a*, 37*c* and 15**.

The carbons 32, 36 are connected via electric cords **39*a*, 39*b* to an external power source (not shown), conventionally. It should be noted that electric connection from said power source to the electrodes 9, 16 may be varied in many ways and that detailed constructions and specific examples herein described are not limitative of the present invention. A known exhaust tube 40 may be provided for communication with the passageway 27*a* formed internally of the cylindrical member 27, so that the gas in the larger drum 1** can be discharged into the atmosphere.

Figure 2:
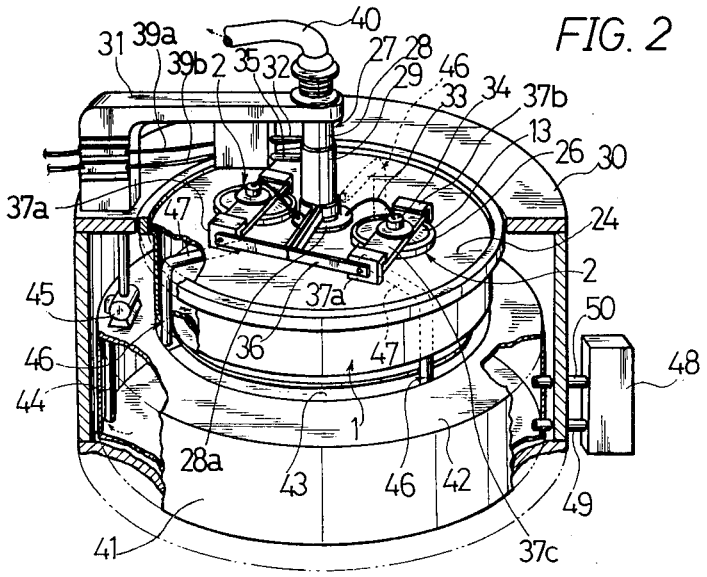
FIG. 2 is a perspective view, with parts broken away, showing a modified embodiment of the present invention.
Figure 3:
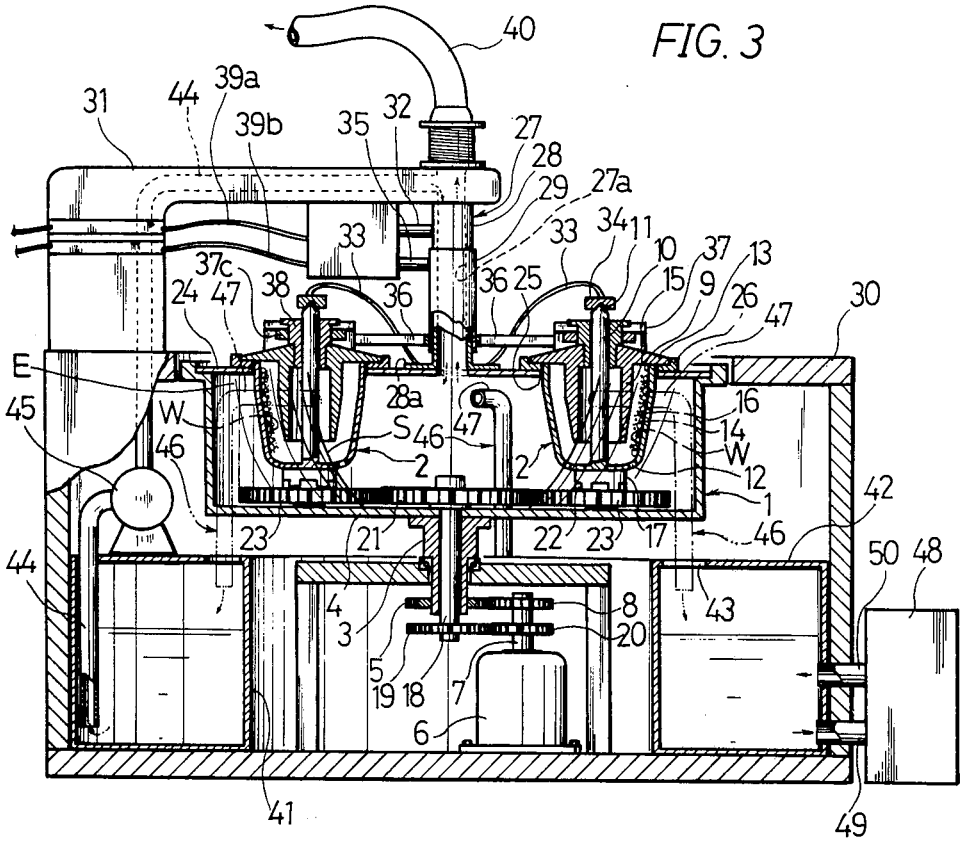
FIG. 3 is an enlarged front elevation, with parts broken away, of the apparatus of FIG. 2.

FIGS. 2 to 4 illustrate the modification of the invention wherein a plating solution cooling and circulating system is provided. Other construction of this modification is substantially the same with that of the preceding embodiment described and illustrated in FIG. 1, and identical reference numerals used in FIG. 1 and FIGS. 2 thru 4 indicate identical elements. Therefore, detailed description of each of the elements 1 to 40 hereinbefore made in conjunction with the first embodiment is not repeated herein.

The cooling and circulating system includes a cooling unit 48 known per se for cooling the plating solution, and a tank 41 of considerably large capacity. The tank may preferably be formed into annular cylindrical construction to provide a cylindrical space in the center thereof, and disposed within the housing 30, so that the drive mechanism including the drive unit 6 can be accommodated in said space. The cooling unit 48 may be installed externally of the housing 30, and intercommunicated with said tank 41 through inlet and outlet pipes 49, 50.

The system further includes a feed pipe 44 with a circulating pump 45, and the passageway 27*a* described in the foregoing, and at least one overflow or discharging pipe 46. The feed pipe 44 originates in the inside of the tank 41 and preferably extends through the inside of or otherwise along with the outside of the support arm 31 to terminate in said passageway 27*a* which is in communication with inside of the larger drum 1.

The overflow pipe 46 rises up from inside of the tank 41 through an annular slot 43 formed in the top wall 42 of the tank and further extends through the alternative of the bottom or the side wall of the larger drum 1 to terminate in the inside of the larger drum 1, in such a manner that, when the drum 1 rotates, the pipe 46, which is fixed to said drum 1, is also permitted to rotate therewith, with its lower end portion received in said slot 43. The pipe 46 has a free terminal end with an inlet mouth for taking in the plating solution for discharging.

The terminal end of the pipe 46 may be bent to provide a substantially horizontal extension 47 directed to the center of the drum 1. The length L (FIG. 4) of the extension may preferably be predetermined so that the excessive quantity of the plating solution can be effectively discharged from the drums 1, 2 into the tank 41 through the pipe 46 during operation, to provide that, when both drums 1, 2 are in rotation, the plating solution confined within the drums 1, 2 under the influence of the developed centrifugal forces can be limited in quantity at most to such an extent enough to immerse the cylindrical elements 15 serving as anodes therein. Further, said inlet mouth should be spaced apart from the internal circumference of the larger drum 1 by such a distance as at least large enough to permit almost one outer half of said cylindrical element 15 to be immersed in the plating solution confined in the smaller drum under the influence of the centrifugal forces developed when said drums 1, 2 are in rotation.

In operation, in particular to the first embodiment of FIG. 1, after the cap 34 being taken off the top end 11 of the pole, the set plate 37*c* is manually turned for disengagement from the fixing elements 37*a*, 37*b*. Then, the lid 13 with the socket member 38 is removed in order to put a desired number of small workpieces W into each smaller drum 2. If desired, a sufficient quantity of the plating solution E may be filled at this stage into the larger drum 1 through the holes 12 of the smaller drums 2. Also at this stage, it is possible, if desired, to take the smaller drums out of the larger drum through the openings 25. After that, each of the smaller drums is again covered with the lid 13, respectively, in reverse order.

After the above-mentioned preliminary operation being is over, the carbons 32, 35 are energized, and at the same time, the drive unit 6 is driven. The power of the drive unit is transmitted through the transmitting elements 7, 8, 5, 3 to the larger drum 1 for rotation. While, the power is also transmitted through the transmitting elements 7, 20, 19, 18, 21, 23 to each smaller drum 2 for simultaneous rotation. Thus, each of the smaller drums not only revolves around the axis of the larger drum as the latter rotates, but also synchronously rotates on its own axis, to develop the centrifugal forces. More specifically, the centrifugal forces thus developed cooperate to hold the workpiece W forcibly in good contact with such limited area of the cathode surface 9 as farthest from the center of the larger drum, as well as to force the confined plating solution E against the internal circumference of the larger drum, with the cylindrical elements 15 immersed therein, as shown in FIG. 1. Thus, the efficient electrolytic performance can be effected between the electrode 9 and the counter-electrodes 16. It will be easily understood that each of the workpieces W is urged to roll on the cathode surface 9 without losing the required good contact relation therewith, as long as each smaller drum is rotating on its own axis, thereby realizing the expected uniform and blindspotless electrodeposition. Further, an undesirable rise of the solution temperature can be minimized since the heating by the active electric current occurs only in a limited local area defined by the two electrodes 9, 16 within each smaller drum 1, and yet the total quantity of the solution E contained in the drum 1 is considerably large enough to prevent the solution from being soon heated up. Still further, since both drums 1, 2 are intercommunicated with each other through a plurality of holes 12 formed in the smaller drums, the heated solution E confined within the smaller drums 2 can be interfluently exchanged for non-heated new one.

The operational manner of the modified embodiment illustrated in FIGS. 2 to 4 is substantially the same with that of the preceding embodiment, except that the plating solution is cooled in the cooling unit 48 and circulated by means of the pump 45 along with the flow circuit composed of the passageway elements 44, 27*a*, 1, 46 and 41. To describe in detail, the solution E flows through the inlet pipe 49 into the cooling unit 48 where it is cooled. The solution thus cooled is returned into the tank 41 through the outlet pipe 50, the solution being effectively cooled all the while the unit 48 is in operation.

The solution in the tank 41 is forcibly fed by means of the circulating pump 45 into the larger drum 1 through the feed pipe 44 and the passageway 27*a*, while the excessive quantity of solution is discharged from inside of the larger drum 1 into the tank through the overflow pipe 46.

When the larger and the smaller drums 1, 2 are in rotation, the solution E confined in the drums 1, 2 is forced against the internal circumference of the drum 1 under the influence of the centrifugal forces to assume such a position as particularly shown in FIG. 4 wherein the surface of the solution E is designated by reference character S. So far as both of the electrodes 9, 16 are under the surface S and immersed in the solution E, the electrolytic performance can be effected. Therefore, it is apparent that the solution beyond the surface S is the excessive and unnecessary one to be returned into the tank 41 through the overflow pipe 46.

In order to keep said surface S in good position, the length L of the horizontal extension 47 should be predetermined so that its inlet mouth is located slightly beyond the surface S. It is readily comprehensible that the cooling and circulating system facilitates preventing the solution from being heated up thereby to insure the good plating efficiency.

The invention being thus described, it will be obvious that the same may be varied in many ways. Such modifications are not to be regarded as a departure from the spirit and scope of the present invention, and all such modifications are intended to be included within the scope of the appended claims.

I claim:

1. An automatic electroplating apparatus comprising at least one power-driven larger rotary drum designed so as to contain a plating solution therein,
at least one power-driven smaller rotary drum disposed in said larger drum,
intercommunication means formed in said smaller drum for permitting said plating solution to interflow between insides of said smaller drum and said larger drum,
a cathode means provided internally of said smaller drum,
an anode means provided internally of said smaller drum in spaced apart relation with said cathode means,
said smaller drum being arranged so as to rotate on its own axis and to orbitally revolve around a vertical axis of said larger drum.

2. The apparatus, as set forth in claim 1, wherein said cathode means is in the form of an internal surface of said smaller drum.

3. The apparatus, as set forth in claim 1, wherein said anode means is in the form of an outer surface of an anodic element disposed within said smaller drum.

4. The apparatus, as set forth in claim 1, wherein said intercommunication means is in the form of a plurality of through holes formed in said smaller drum.

5. The apparatus, as set forth in claim 1, wherein both of said larger and smaller drums are arranged so as to be simultaneously driven by means of a single drive source.

6. The apparatus, as set forth in claim 5, wherein power of said drive source is transmitted to said larger drum via a hollow shaft, as well as to said smaller drum via an inner shaft passing through said hollow shaft and via transmission means cooperatively connected to said inner shaft.

7. The apparatus, as set forth in claim 6, wherein said transmission means includes a main gear wheel disposed within said larger drum and coaxially mounted on an upper extension of said inner shaft, and at least one driven gear wheel engaged with said main gear wheel and operatively connected to said smaller drum for rotation.

8. The apparatus, as set forth in claim 1, wherein said larger and the smaller drums are arranged so as to be driven independently by means of different drive sources.

9. The apparatus, as set forth in claim 1, wherein said anodic element is in the form of a cylindrical element having such a periphery as to provide an annular space between said internal surface of the smaller drum and said periphery.

10. The apparatus, as set forth in claim 1, wherein said smaller drum is arranged so as to be detachably received in said larger drum.

11. The apparatus, as set forth in claim 10, wherein said larger drum is covered at a top portion with a cover plate having at least one opening through which said smaller drum can be received into and removed out of said larger drum.

12. The apparatus, as set forth in claim 10, wherein an annular support of non-conductive character is disposed on said cover plate so as to enclose said opening.

13. The apparatus, as set forth in claim 1, wherein said smaller drum includes an open top covered with insulation with a holed lid formed integral with said anodic element, said lid being adapted so as to be detachable from said open top of the smaller drum.

14. The apparatus, as set forth in claim 13, wherein said holed lid is supported by said annular support at a marginal edge thereof.

15. The apparatus, as set forth in claim 1, wherein said smaller drum is formed so as to be gradually reduced in diameter toward bottom.

16. The apparatus, as set forth in claim 4, wherein said plurality of through holes of said smaller drum are in the form of through holes formed in the bottom wall of said smaller drum.

17. The apparatus, as set forth in claim 1, wherein a cylindrical member is fixedly secured on said cover plate so as to extend upward from a center of said plate, said cylindrical member being so constructed as to provide a cathodic conductor and an anodic conductor insulated from each other, and said cathodic conductor being in contact with a cathodic carbon connected to an external power source while said anodic conductor being in contact with an anodic carbon connected likewise to said power source.

18. The apparatus, as set forth in claim 1, wherein said smaller drum has an upright pole extending upward from a center of the bottom wall thereof to protrude out of said holed lid, and said pole is electrically connected at top with said cathode conductor by means of a conductor wire.

19. The apparatus, as set forth in claim 18, wherein a terminal cap is interposed between the top of said pole and one terminal end of said conductor wire, said cap being mounted on said top in such a relatively rotatable contact relation as that said cap is stationary while said pole is rotatable.

20. The apparatus, as set forth in claim 17, wherein conductive means is provided for electrically connecting said anodic conductor with said periphery of said anodic element.

21. The apparatus, as set forth in claim 20, wherein said conductive means includes a conductor strip connected at one end to said anodic conductor and at the other end to the alternative of a pair of fixing elements or oppositely disposed in spaced apart relation so as to flank said annular socket, and a set plate which is connected to said lid and disengageably interposed between said pair of fixing elements.

22. The apparatus, as set forth in claim 17, wherein said cylindrical member is formed with an internal passageway which is intercommunicated with the inside of said larger drum through a hole formed in the center of said cover plate.

23. The apparatus, as set forth in claim 22, wherein an exhaust tube is provided so as to be intercommunicated with the inside of said larger drum through said passageway.

24. The apparatus, as set forth in claim 17, wherein said cylindrical member is rotatably supported by a supporting arm disposed above a top side of a frame housing.

25. The apparatus, as set forth in claim 1, wherein means are provided for cooling and circulating said plating solution, which comprises a cooling unit, a tank intercommunicably connected to said cooling unit, and a flow circuit.

26. The apparatus, as set forth in claim 25, wherein said cooling unit is provided externally of said housing.

27. The apparatus, as set forth in claims 25 or 26, wherein said cooling unit is intercommunicably connected to said tank through at least one inlet pipe and at least one outlet pipe.

28. The apparatus, as set forth in claim 25, wherein said tank is formed into annular cylindrical construction to provide a cylindrical space in center thereof, and disposed within said housing.

29. The apparatus, as set forth in claim 28, wherein a drive mechanism including a drive unit is accommodated within said cylindrical space.

30. The apparatus, as set forth in claim 25, wherein said flow circuit comprises at least one feed pipe intercommunicably connecting inside of said tank with inside of said larger drum, at least one circulating pump operatively connected to said feed pipe, and at least one discharging pipe intercommunicably connecting inside of said larger drum with the inside of said tank.

31. The apparatus, as set forth in claim 25, wherein said flow circuit comprises a feed pipe, a circulating pump, said passageway formed internally of said cylindrical member for intercommunicating said feed pipe with the inside of said larger drum, and at least one discharging pipe adapted to intercommunicate inside of said larger drum with the inside of said tank.

32. The apparatus, as set forth in claim 31, wherein said feed pipe passes through a hollow space formed internally of said support arm.

33. The apparatus, as set forth in claim 25, wherein at least one discharging pipe rises up from the inside of said tank through an annular slot formed in the top wall of the tank and further extends through the bottom wall of said larger drum to terminate in the inside of the drum, said pipe being so arranged as to move round along with rotation of said larger drum, keeping its lower end portion received in said annular slot.

34. The apparatus, as set forth in claim 31, wherein said discharging pipe is in the form of an overflow pipe having an extension which has a free open end serving as an inlet mouth for taking in an excessive quantity of the plating solution to discharge the same from the large drum into said tank, said inlet mouth being spaced apart by a certain distance from the internal circumference of said larger drum, said distance being at least large enough to permit nearly one outer half of said cylindrical element to be immersed in the plating solution confined in the smaller drum under influence of centrifugal forces developed when said drums are in rotation.

35. The apparatus, as set forth in claim 31, wherein said extension is disposed substantially horizontally and directed to center of the larger drum.

* * * * *